United States Patent [19]

Matthews

[11] 4,116,146

[45] Sep. 26, 1978

[54] SEWING MACHINES

[75] Inventor: Denis Matthews, Sutton in Ashfield, England

[73] Assignee: Mathbirk Limited, Sutton in Ashfield, England

[21] Appl. No.: 795,924

[22] Filed: May 11, 1977

[30] Foreign Application Priority Data

May 19, 1976 [GB] United Kingdom ..... 20606/76

[51] Int. Cl.[2] ..... D05B 75/06

[52] U.S. Cl. ..... 112/217.2

[58] Field of Search ..... 112/217.1, 217.2, 217.3, 112/217.4, 258, 260, 25, 155, 121.14

[56] References Cited

U.S. PATENT DOCUMENTS

| | | | |
|---|---|---|---|
| 947,605 | 1/1910 | Tillie | 112/155 X |
| 1,342,686 | 6/1920 | McCracken | 112/217.2 |
| 1,649,319 | 11/1927 | Molyneux | 112/121.14 X |
| 1,721,069 | 7/1929 | Chason | 112/217.3 |
| 2,845,885 | 8/1958 | Scarrone | 112/155 X |
| 3,297,387 | 1/1967 | Parsons | 112/217.1 X |
| 3,316,869 | 5/1967 | Shelton | 112/25 X |
| 3,847,097 | 11/1974 | Dusch et al. | 112/121.14 |

FOREIGN PATENT DOCUMENTS

| | | | |
|---|---|---|---|
| 1,158,101 | 1/1958 | France | 112/155 |
| 1,543,962 | 9/1968 | France | 112/217.1 |
| 163,063 | 5/1964 | U.S.S.R. | 112/217.3 |

*Primary Examiner*—George H. Krizmanich
*Attorney, Agent, or Firm*—Frailey & Ratner

[57] ABSTRACT

A work station comprising at least two sewing machines, or machines similar thereto for joining together separate pieces of fabric, and a horizontal work surface on which each machine is mounted with capacity for rotation about a vertical axis. The horizontal work surface and the machines are disposed relative to each other so that one person is enabled to operate all of the machines at the work station. The work surface may be of L-shaped configuration, with a sewing machine mounted rotatably on each limb of the L. Each machine may be provided with a vertical shaft having a foot engaging plate to permit rotation of the machines from beneath the horizontal work surface.

2 Claims, 2 Drawing Figures

SEWING MACHINES

This invention is for improvements in or relating to a sewing, linking, overlocking or seaming machine, hereinafter collectively referred to either as a "sewing machine" or as "sewing machines" and has for one object to provide an improved arrangement of sewing machines which will enable one operative to operate on more than one sewing machine and hence to increase the output of a sewing machine operator.

It is known to mount a sewing machine on a floor standing base and to provide for the associated control parts of the sewing machine on said base. It is also known to mount a sewing machine for rotation about a vertical axis relative to a horizontal surface, see for example my co-pending U.S. Pat. application Ser. No. 795,925.

In the said co-pending application the sewing machine is described as being rotatably mounted relative to a horizontal work surface in the form of a table which may for example be a generally rectangular bench or desk with the appropriate facilities for storage of fabric and other controls located in shelves, drawers or such like beneath the said work surface. The sewing machine aforesaid is mounted in an aperture formed in the work table and is rotatably supported by bearings located beneath the work surface table, so that the machine is able to rotate freely relative to the table. By mounting the rotatable sewing machine on the table relative to a work surface, the customary stand on which the sewing machine is mounted becomes unnecessary.

According to the present invention there is provided a work station for the joining of textile fabrics comprising at least two sewing machines, a table in desk like form having a horizontal work surface on which each of the said sewing machines is mounted for rotation about a substantially vertical axis, said horizontal work surfaces together with the sewing machines rotatably mounted thereon being disposed relative to each other so that an operative may be placed in a position to operate on each of said sewing machines in turn.

According to the present invention there may be provided more than two such sewing machines but the invention is particularly concerned with an arrangement whereby two sewing machines are provided.

Desirably the leading edge of the substantially horizontal work surface on which the sewing machines are mounted are arranged to be at an angle as for example an angle which may be in the order of 90°. Thus a substantially L-shaped work station is provided in which the operative will sit on the line bisecting the angle between the two work surfaces and if seated on a rotatable chair or the like the operative may actuate each of the two sewing machines in turn merely by rotating the chair through approximately 90° and thereby to face each sewing machine.

Figure 1:
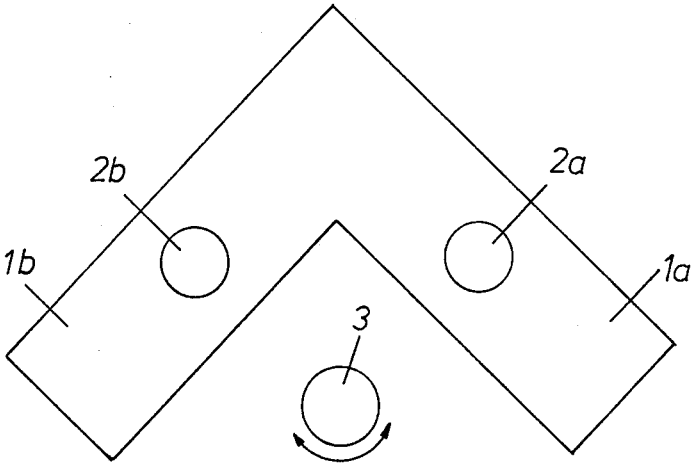
Figure 2:
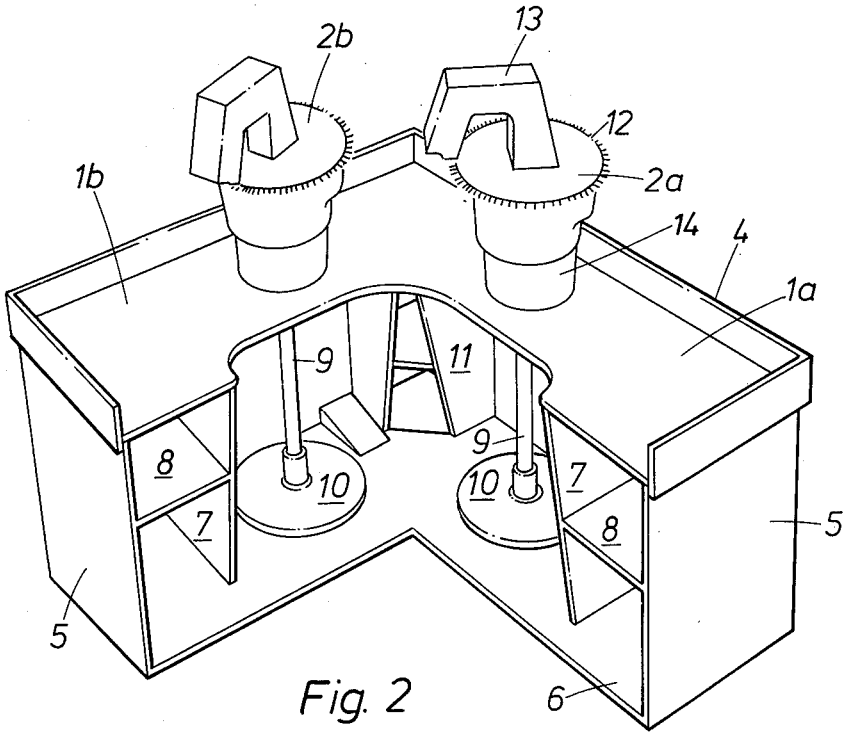

Reference is now made to the accompanying drawings in which:

FIG. 1. illustrates schematically in plan one arrangement according to the present invention, and FIG. 2 is a schematic view in perspective of an arrangement according to the present invention.

Referring firstly to FIG. 1 there are provided two substantially horizontal work surfaces indicated at 1*a* and 1*b*. Mounted relative to each work surface is a conventional sewing machine indicated at 2*a* and 2*b* respectively. It will be appreciated that the work surfaces are arranged at approximately 90° to each other forming an L-shaped work station having limbs 1*a*, 1*b* of substantially equal length. An operative may sit in a rotatable chair 3 which enables the operative to turn from one sewing machine to the next and back again.

Referring now to FIG. 2 the work surfaces 1*a* and 1*b* each have mounted relative thereto and in a rotatable manner the sewing machines 2*a* and 2*b*. Each machine includes a casing 14 rotatably mounted relative to the horizontal work stations 1*a* and 1*b*, and a plurality of radially extending points 12 on which the work to be joined is impaled. A head 13 is provided which houses the mechanism for a reciprocating needle according to known techniques of sewing machines. Each sewing machine 2*a* and 2*b* preferably is mounted in the manner described in my co-pending application Ser. No. 795,925, aforesaid. More particularly, each sewing machine 2*a* and 2*b* is mounted in an aperture (not shown) formed in each work surface 1*a* and 1*b*, with its casing 14 rotatably supported by bearings (not shown) located in or below each aperture, to enable the free rotation of the casings 14 relative to their adjacent work surfaces 1*a* and 1*b*. The work surfaces 1*a* and may be provided with a peripheral upstanding edge 4 to prevent work from falling off the edge thereof. The work surfaces of 1*a* and 1*b* are supported from a base 6 by upstanding sides 5, which are sub-divided in their interior by partitions 7 and by shelves 8 so as to define compartments within the work station in which work may be located for the opertive. Beneath each work surface 1*a* and 1*b* is a vertical shaft 9 which is secured to the lower portions of the casings 14 extending below the work surfaces. The lower end of each shaft 9 is housed in bearings not shown in the base 6 and provided with a foot engaging disc 10 so that the operative may readily rotate each sewing machine 2*a* and 2*b* either by engaging the casings 14 with the hands above the work surfaces 1*a* or 1*b*, or by kicking the discs 10 so as to rotate the sewing machine. In the apex of the corner formed by the work surfaces of 1*a* and 1*b* is a housing or cupboard 11 which may be used for the location of electrical or electronic control gear and such like for the control of the two sewing machines.

One of the advantages of the present invention is that an operative may thread the fabric to be linked on to the points on say the sewing machine 2*a* and then set that sewing machine in operation and while that machine is joining, the operative may then turn towards the adjacent sewing machine 2*b* and run fabric onto the points of that machine and set that machine in operation. By the time the operative turns back to machine 2*a* it will have finished joining the pieces of fabric which have been impaled onto the points. The operative can then remove the fabric from those points, run further fabric onto them, and set that machine 2*a* in operation, then return to the machine 2*b* by which time that will have joined the fabric previously impaled onto the points and so on. Thus by such an arrangement an operative may ensure that at least one of the two sewing machines is constantly sewing fabric. By such an arrangement the output from the operative may be as high or higher than an operative operating a machine working at maximum speed. However, with this arrangement each machine may be arranged to operate at a lower speed and it will be appreciated that by having the sewing machine and its co-operating sewing needles operating at a lower speed, there is less liklihood of breakage of needles and less wear and tear on the machine which in turn involves less maintenance and hence less down time of the machine itself.

Thus although initial higher capital cost are involved in an installation of the present invention it is thought that by one operative working two machines in the manner aforesaid which machines are operating at a lower speed that hitherto that a higher output of joined fabric will result.

What we claim is:

1. A work station for the joining together of textile fabrics comprising at least two rotatable sewing machines and a bench having a horizontal work surface on which each of said sewing machines is mounted for rotation about a substantially vertical axis relative to the work surface, said work station characterized by:

(a) an L-shaped horizontal work surface having limbs of substantially equal length, each limb supporting rotatably at least one sewing machine, whereby said work surface together with the sewing machines rotatably mounted thereon are disposed relative to each other so that an operator may be placed in a position to operate each of said sewing machines in turn, (b) a base spaced below the work surface, (c) spaced vertical members mounted on the base for supporting the work surface, (d) partitions interposed between the work surface and the base for defining shelves, cupboards, compartments and the like and (e) a vertical, rotatable shaft depending from each sewing machine and extending downwardly toward the base, each said shaft having means affixed thereto for imparting rotation to the sewing machine from which the shaft depends.

2. A work station according to claim 1, further including a rotatable chair spaced proximate to and substantially equidistant from each sewing machine, whereby the operator, while seated, may have ready and equal access to each sewing machine, and may set each sewing machine in operation successively in turn.

* * * * *